US009027263B2

(12) United States Patent
Leonard

(10) Patent No.: US 9,027,263 B2
(45) Date of Patent: May 12, 2015

(54) METHOD OF AUTOMATED VARIABLE SPEED CONTROL OF MOVEMENT OF A CUTTER HEAD OF A DREDGING CUTTER

(71) Applicant: Jeremy Leonard, Ardrossan (CA)

(72) Inventor: Jeremy Leonard, Ardrossan (CA)

( * ) Notice: Subject to any disclaimer, the term of this patent is extended or adjusted under 35 U.S.C. 154(b) by 0 days.

(21) Appl. No.: 13/928,241

(22) Filed: Jun. 26, 2013

(65) Prior Publication Data

US 2014/0026448 A1 Jan. 30, 2014

(30) Foreign Application Priority Data

Jul. 30, 2012 (CA) ..... 2784850

(51) Int. Cl.

| | |
|---|---|
| ***E02F 3/16*** | (2006.01) |
| ***E02F 3/90*** | (2006.01) |
| ***E02F 3/88*** | (2006.01) |
| ***E02F 3/92*** | (2006.01) |

(52) U.S. Cl.

CPC ..... *E02F 3/907* (2013.01); *E02F 3/8808* (2013.01); *E02F 3/9231* (2013.01)

(58) Field of Classification Search

USPC ..... 37/307–346

See application file for complete search history.

(56) References Cited

U.S. PATENT DOCUMENTS

| | | | | |
|---|---|---|---|---|
| 3,380,179 | A * | 4/1968 | Schmidt | 37/312 |
| 3,917,326 | A * | 11/1975 | Grable | 299/8 |
| 3,924,896 | A * | 12/1975 | Blankenship | 299/18 |
| 4,156,317 | A * | 5/1979 | Schmidt | 37/312 |
| 4,212,121 | A * | 7/1980 | Kato et al. | 37/312 |
| 4,232,903 | A * | 11/1980 | Welling et al. | 299/8 |
| 4,394,265 | A * | 7/1983 | van Drimmelen et al. | 210/242.3 |
| 4,451,177 | A | 5/1984 | Goldsmith | |
| 4,585,274 | A * | 4/1986 | Grable | 299/7 |
| 5,311,682 | A * | 5/1994 | Sturdivant | 37/312 |
| 5,791,074 | A * | 8/1998 | Pryor | 37/345 |
| 7,083,734 | B2 | 8/2006 | Happonen | |
| 7,093,382 | B1 * | 8/2006 | Price | 37/309 |
| 8,165,722 | B2 * | 4/2012 | Yoon et al. | 700/282 |
| 2010/0299971 | A1 * | 12/2010 | Verstraelen et al. | 37/312 |

FOREIGN PATENT DOCUMENTS

| | | |
|---|---|---|
| CA | 2 730 861 A1 | 8/2011 |
| GB | 2 103 099 A | 2/1983 |

OTHER PUBLICATIONS

Canadian Search Report mailed Dec. 10, 2013, issued in Canadian Application No. 2,784,630, filed Jul. 30, 2012, 2 pages.

Canadian Search Report mailed Dec. 10, 2013, issued in corresponding Canadian Application No. 2,784,850, filed Jul. 30, 2012, 2 pages.

* cited by examiner

*Primary Examiner* — Matthew D Troutman

(74) *Attorney, Agent, or Firm* — Christensen O'Connor Johnson Kindness PLLC

(57) ABSTRACT

An automated variable speed control system for a cutter head of a dredging cutter has a cutter head and a pump. The pump pumps cuttings from the cutter head through a cuttings discharge line. A sensor monitors amperage draw of the pump. A controller controls speed of movement of the cutter head based upon data received from the sensor. The controller increases a speed of movement of the cutter head through the materials when the amperage draw of the pump falls below the determined amperage range and the controller decreases the speed of movement of the cutter head through the materials when the amperage draw of the pump exceeds the determined amperage range.

2 Claims, 1 Drawing Sheet

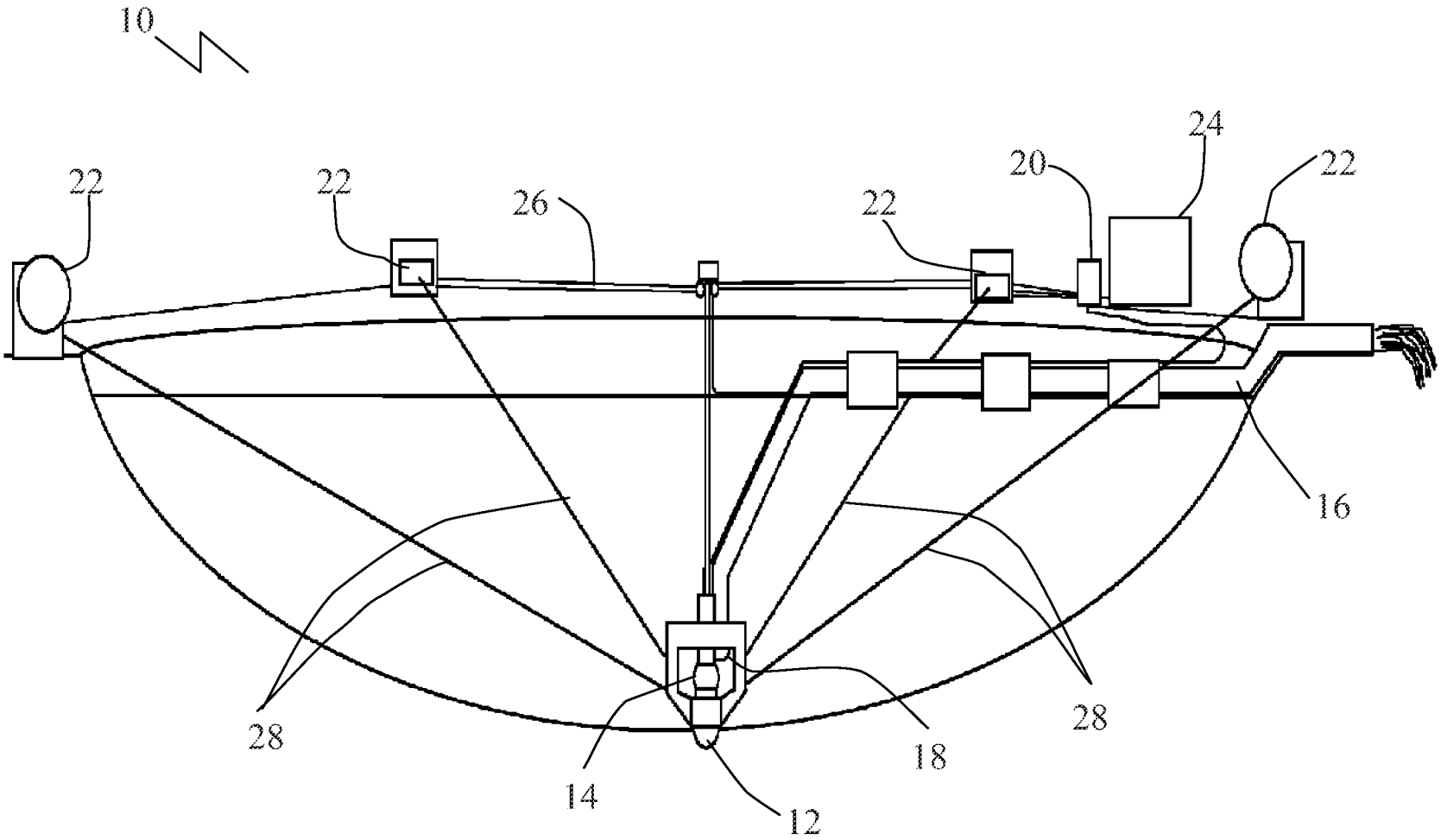
10
22
22
22
22
24
20
26
16
28
28
18
12
14

METHOD OF AUTOMATED VARIABLE SPEED CONTROL OF MOVEMENT OF A CUTTER HEAD OF A DREDGING CUTTER

FIELD

There is described a method of automated variable speed control of movement of a cutter head of a dredging cutter and an automated variable speed control system for a dredging cutter head in accordance with this method.

BACKGROUND

When dredging, a cutter head is set into material at a bottom of a body of water and is moved through the material. The speed at which the cutter head moves through the material is critical. If the cutter head moves too aggressively through the material, the cuttings produced will plug cutting discharge lines. On the other hand, if the cutter head moves too slowly through the material, the cutter head will be largely ineffective and a fluidizing stream carrying the cuttings through the discharge lines will be largely water. The problem is made more complex by a wide range of soils, which react to the cutter head in different ways. At one end of the range are clay soils. A cutter head passing through clay soils will cut a clearly defined trench. At an opposite end of the range are sandy soils, which tend to collapse and flow around the cutter head. This combination of problems makes it very difficult to automate the operation of the cutter head so that a computer controller can monitor and operate the movement of the cutter head without requiring constant monitoring by human operators. What is required is a method that of automated control of movement of a cutter head of a dredging cutter.

SUMMARY

According to one aspect there is provided a method of automated variable speed control of a cutter head of a dredging cutter. A first step involves determining what amperage range a pump operates at when pumping cuttings produced by the cutter head with a discharge stream of a desired proportion of cuttings and water in soil conditions existing in a body of water. A second step involves creating a control loop in which sensor data concerning amperage of the pump is fed to a computer controller, the computer controller increasing a speed of movement of the cutter head through the materials when the amperage draw of the pump falls below the determined amperage range and the computer controller decreasing the speed of movement of the cutter head through the material when the amperage draw of the pump exceeds the determined amperage range.

According to another aspect there is provided an automated variable speed control system for a cutter head of a dredging cutter. The control system includes a cutter head, a pump pumping cuttings from the cutter head through a cuttings discharge line, and a sensor monitoring amperage draw of the pump. A controller controls the speed of movement of the cutter head through the material based upon data received from the sensor. The computer controller increases a speed of movement of the cutter head through the materials when the amperage draw of the pump falls below the determined amperage range and the computer controller decreases the speed of movement of the cutter head through the material when the amperage draw of the pump exceeds the determined amperage range.

BRIEF DESCRIPTION OF THE DRAWINGS

These and other features will become more apparent from the following description in which reference is made to the appended drawings, the drawings are for the purpose of illustration only and are not intended to be in any way limiting, wherein:

FIG. 1 is a side elevation view of an automated variable speed control system.

DETAILED DESCRIPTION

An automated variable speed control system generally identified by reference numeral 10 will now be described with reference to FIG. 1.

Structure and Relationship of Parts:

Referring to FIG. 1, an automated variable speed control system 10 has a cutter head 12. A pump 14 pumps cuttings from cutter head 12 through a cuttings discharge line 16. A sensor 18 monitors amperage draw of pump 14. A controller 20 controls speed of movement of cutter head 12 based upon data received from sensor 18. Controller 20 increases a speed of movement of cutter head 12 through the materials when the amperage draw of pump 14 falls below the determined amperage range and controller 20 decreases the speed of movement of cutter head 12 through the materials when the amperage draw of pump 14 exceeds the determined amperage range.

Automated variable speed control system 10 may be used in a dredging system which utilizes winches 22 which are connected to a power generator 24 by power cord 26. Winching cables 28 are connected to pump 14 to allow movement of pump 14 around a body of water. In addition to controlling speed movement of cutter head 12, controller 20 also controls operation of winches 22.

Operation:

Pump 14 pumps cuttings produced by cutter head 12 through cuttings discharge line 16. When a desired proportion of cuttings and water in soil conditions exists in a body of water, the amperage range that pump 14 operates at is determined using sensors 18. A control loop is created in which sensor data from sensors 18 is fed to controller 20. Controller 20 increases a speed of movement of cutter head 12 through the materials when amperage draw of pump 14 falls below the determined amperage range. Controller 20 decreases the speed of movement of cutter head 12 through the material when amperage draw of pump 14 exceeds the determined amperage range.

In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be one and only one of the elements.

The scope of the claims should not be limited by the illustrated embodiments set forth as examples, but should be given the broadest interpretation consistent with a purposive construction of the claims in view of the description as a whole.

What is claimed is:

1. A method of automated variable speed control of a cutter head of a dredging cutter, comprising:

determining a current range that a pump operates at when pumping cuttings produced by the cutter head with a discharge stream of a desired proportion of cuttings and water in soil conditions existing in a body of water; and creating a control loop in which sensor data concerning a current draw of the pump is fed to a computer controller, the computer controller increasing a speed of lateral movement of the cutter head through material when the current draw of the pump falls below the determined current range and the computer controller decreasing the speed of lateral movement of the cutter head through the material when the current draw of the pump exceeds the determined current range, wherein the speed of the cutter head is controlled by controlling the operation of winches attached to the dredging cutter.

2. An automated variable speed control system for a cutter head of a dredging cutter, comprising:

a cutter head;

a pump pumping cuttings from the cutter head through a cuttings discharge line;

a sensor monitoring current draw of the pump;

a controller controlling a speed of lateral movement of the cutter head based upon data received from the sensor, the computer controller increasing the speed of lateral movement of the cutter head through material when the current draw of the pump falls below a determined current range and the computer controller decreasing the speed of lateral movement of the cutter head through the material when the current draw of the pump exceeds the determined current range, wherein the controller is connected to winches that are attached to the dredging cutter by cables, the speed of lateral movement of the cutter head through the material being controlled by controlling the winches.

* * * * *